US011027183B2

(12) United States Patent
Brewer et al.

(10) Patent No.: US 11,027,183 B2
(45) Date of Patent: Jun. 8, 2021

(54) WALL CLIMBING STRUCTURE

(71) Applicant: Brewers Ledge Inc., Randolph, MA (US)

(72) Inventors: George W. Brewer, Newton Center, MA (US); W. Conant Brewer, Brookline, MA (US)

(73) Assignee: Brewers Ledge Inc., Randolph, MA (US)

( * ) Notice: Subject to any disclaimer, the term of this patent is extended or adjusted under 35 U.S.C. 154(b) by 0 days.

(21) Appl. No.: 16/780,598

(22) Filed: Feb. 3, 2020

(65) Prior Publication Data

US 2020/0246671 A1 Aug. 6, 2020

Related U.S. Application Data

(60) Provisional application No. 62/801,215, filed on Feb. 5, 2019.

(51) Int. Cl.
*A63B 69/00* (2006.01)
*A63B 21/00* (2006.01)
*A63B 22/04* (2006.01)

(52) U.S. Cl.
CPC ..... *A63B 69/0048* (2013.01); *A63B 21/151* (2013.01); *A63B 22/04* (2013.01); *A63B 2225/09* (2013.01)

(58) Field of Classification Search
CPC ..... A63B 69/0048; A63B 22/04
See application file for complete search history.

(56) References Cited

U.S. PATENT DOCUMENTS 5,125,877 A * 6/1992 Brewer ..... A63B 69/0048 482/37
5,328,422 A * 7/1994 Nichols ..... A63B 22/001 482/111
5,352,166 A * 10/1994 Chang ..... A63B 22/04 482/37
5,549,195 A * 8/1996 Aulagner ..... A63B 69/0048 198/850
5,919,117 A * 7/1999 Thompson ..... A63B 22/02 482/37
6,095,952 A * 8/2000 Ali ..... A63B 22/02 482/35

(Continued)

*Primary Examiner* — Jennifer Robertson
(74) *Attorney, Agent, or Firm* — Rauschenbach Patent Law Group, LLC; Kurt Rauschenbach

(57) ABSTRACT

A climbing structure includes a support frame and a wall assembly. The wall assembly comprises a chain arranged as a loop with an array of climbing panels attached to the chain so as to maintain a configuration that rotates the climbing panels downward as the user climbs to achieve a continuous climbing experience. A lower shaft assembly includes a shaft that rotates based on an angle of the wall assembly. A sprocket is mounted to the shaft such that the shaft and the sprocket rotate independently to maintain tension on the chain as the climbing panels rotate downward. A cable hub assembly is rigidly attached to the shaft and secures a cable that is attached to the support frame. A disc braking system includes a disc rigidly attached to the shaft and a caliper mounted on bearing bolts such that the disc braking system fixes the angle of the wall assembly without affecting the continuous climbing experience.

10 Claims, 10 Drawing Sheets

(56) References Cited

U.S. PATENT DOCUMENTS

| | | | | |
|---|---|---|---|---|
| 6,231,482 | B1 * | 5/2001 | Thompson | A63B 22/02 482/37 |
| 6,551,215 | B1 * | 4/2003 | Gordon | A63B 69/0048 472/134 |
| 6,860,836 | B1 * | 3/2005 | Wu | A63B 22/001 198/850 |
| 7,572,208 | B2 * | 8/2009 | Brewer | A63B 69/0048 482/37 |
| 9,017,224 | B1 * | 4/2015 | Singley | A63B 22/0023 482/52 |
| 9,440,132 | B2 * | 9/2016 | Brewer | A63B 69/0048 |
| 2006/0240949 | A1 * | 10/2006 | Wu | A63B 22/0023 482/37 |
| 2007/0142176 | A1 * | 6/2007 | Brown | A63B 22/04 482/7 |
| 2007/0254779 | A1 * | 11/2007 | Vanamo | A61H 1/005 482/35 |
| 2008/0015090 | A1 * | 1/2008 | Brewer | A63B 69/0048 482/37 |
| 2012/0184409 | A1 * | 7/2012 | Beal | A63B 23/1209 482/5 |
| 2014/0228177 | A1 * | 8/2014 | Brewer | A63B 21/008 482/37 |

* cited by examiner

WALL CLIMBING STRUCTURE

CROSS REFERENCE TO RELATED APPLICATION

The present application is a non-provisional application of U.S. Provisional Patent Application No. 62/801,215, filed on Feb. 5, 2019, entitled "Wall Climbing Structure". The entire contents of U.S. Provisional Patent Application No. 62/801,215 are herein incorporated by reference.

The section headings used herein are for organizational purposes only and should not to be construed as limiting the subject matter described in the present application in any way.

INTRODUCTION

The popularity of rock climbing has created a market for artificial climbing walls and other climbing structures. Climbing walls with continuous sliding belts have been recently developed to accommodate climbers with limited space. These climbing walls are popular in various gym environments. Such climbing walls provide a continuous climbing surface for recreation, training, rehabilitation, and fitness purposes in a modest foot print that can easily fit into a gym. Some known climbing walls with continuously sliding belts are powered by electric motors. Other climbing walls, such as the climbing walls manufactured by Brewers Ledge Inc., the assignee of the present application, use the climber's own weight to power sliding belts.

Currently, there is a need in the fitness industry for climbing structures that are more compact, simpler to install, and simpler to use. In addition, there is currently a need in the fitness industry for climbing structures that can be more easily configured and that have easy to operation user controls that change the climbing angle of the wall.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1A:
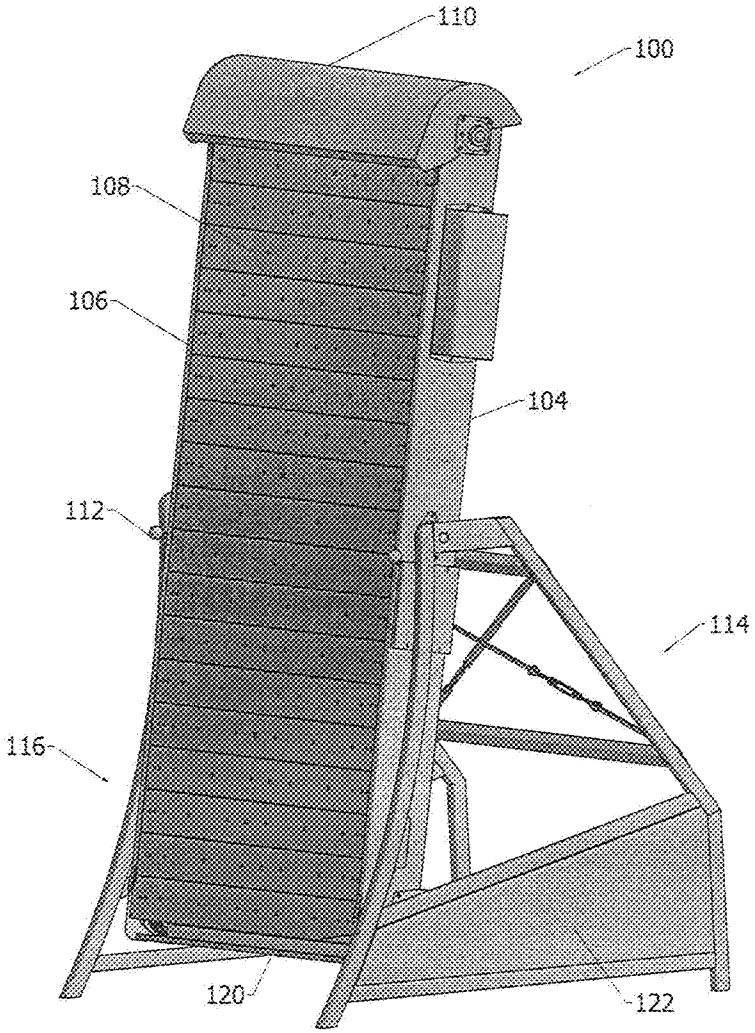
FIG. 1A illustrates an embodiment of a climbing structure of the present teaching set at a 10-degree slab position.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

The present teaching relates to a climbing structure that include a series of climbing panels that are attached to two loops of roller chain at the left and right ends. Top and bottom shaft assemblies are attached to sprockets at the left and right edges. These top and bottom shaft assemblies maintain tension of the left and right loops of roller chain that guide the panels as they travel around the wall. The climbing panels are also guided into a vertical loop with flat surfaces at the front and back by sheet-metal channels.

Known versions of such climbing structures use arrays of climbing panels guided into a vertical loop by sheet metal channels that are mounted at the upper end with bearings on the same shaft that carries the upper sprockets holding the panel array. In these known climbing structures, the entire wall assembly is supported by a large A-frame support frame with bearings at the top to support the upper shaft. The bottom end of the panel array also has a shaft with sprockets that engage the left and right loops of chain and that maintains alignment of the panels as they circulate around the bottom end. The flat series of panels at the front of this array are equipped with climbing holds. The wall rotates under the weight of the climber. To regulate the speed of the wall, a separate sprocket is fitted to the upper shaft, and a hydraulic braking mechanism provides adjustable drag to the rotation. A separate means of cutting off all flow of oil in the hydraulic system provides a way of stopping the wall when the climber is resting near the bottom of the array. See, for example, U.S. Pat. No. 9,440,132, entitled "Rung Wall Ascender" and U.S. Pat. No. 7,572,208, entitled "Climbing Wall with Braking Mechanism", both of which are assigned to the present assignee.

Importantly, in these known structures, the wall orientation is changed from a "slab" orientation to an overhanging angle orientation using a third shaft, which is positioned at the middle of the array. The slab orientation refers to orientations that have small positive angles with respect to the vertical direction. The third shaft on these known structures is fitted with bearings through the center of the two side channels and extends beyond the A-frames. The third shaft does not contact the panels themselves. Cables on each side of the machine are wrapped around this shaft and attached at the front and rear legs of the A-frame. A wheel at one end of third shaft allows the user to adjust the angle by winching the wall forward and back and locking it in place with a simple disk and pin lock. Without the cables in place, the two channels are basically free to swing independently forward and back, since there is very little structure between the two channels. The cables provide the necessary force to maintain alignment of the two channels.

Some known climbing structures use a half-height frame where the wall assembly is mounted by bearings near its center-of-gravity. This configuration eliminates the sheet metal channels and cables. The balance of the wall assembly is arranged so that, without a climber positioned on the structure, the climbing structure naturally tilts forward into the slab position and, with the climber on the climbing structure, the climbing structure tilts back into the overhanging position. A hydraulic cylinder locks the angle and allows the climber to adjust the wall to a steeper angle without dismounting.

Other known climbing structures have a vertical-only position that has a minimum footprint and that is rigidly mounted in a vertical frame. Still other known climbing structures are configured in a steep angle, with a channel pivoting from the bottom, and the substantial weight of the overhanging wall is supported by a sturdy, but somewhat clumsy set of jacks and uprights.

There are numerous drawbacks to these known climbing structures. For example, the large A-frame is rather ungainly and takes up a considerable floor space. Furthermore, the range of angle is limited by the A-frame size and shape. The range of angles is also limited by practical constraints on the angle adjustment cables as the winching-forces in this configuration are relatively high at steeper angles. For example, known cable-based systems are generally limited to about a 12-degree overhang, which is not appropriate for serious climber training. In addition, the overhang angle can only be changed by dismounting or with the aid of a second non-climbing person. These known systems can be cumbersome to adjust and lack the desired flexibility to provide for a large range of climber ability that is typical of users in climbing gyms.

The present teaching addresses shortcomings of known climbing structures. One aspect of the present teaching is to provide a climbing structure with a full range of wall angle adjustment, from beginner level to expert level, with an easy-to-use and convenient interface that does not require dismounting the climber. Various embodiments of the climbing structures of the present teaching include a range of configurations with different footprints and a different range of wall angle adjustments. Also, the wall angle adjustment is robust, relatively trouble-free and economical to make. This is, at least in part, due to the elimination of the hydraulic cylinder that is present in known systems. Also, various embodiments of the climbing structure of the present teaching minimize use of heavy and expensive reinforcing materials.

The climbing structure of the present teaching allows the user to configure the structure by selecting options that suit their own particular situation. That is, the climbing structure can be configured for different ceiling heights, floor spaces, ability levels, etc. For example, some embodiments are configured to provide a full +10 degree to −35 degree range of wall angle adjustment and other embodiments can are configured to provide as little as +10 to −15 degree range of wall angle adjustment. Still other embodiments are configured to provide a +10 to −20 degree range of wall angle range.

More specifically, the present teaching relates to climbing structures that include a series of climbing panels that are, for example, six inches tall and less than or equal to six feet wide or less than or equal to four feet wide. The climbing panels are attached to two loops of roller chain at the left and right ends. Top and bottom shaft assemblies are attached to sprockets at the left and right edges. These top and bottom shaft assemblies maintain tension of the left and right loops of roller chain and guide the panels as they travel around the wall. The climbing panels are guided into a vertical loop with flat surfaces at the front and back by sheet-metal channels. Various embodiments of the climbing structures can range in height, but some specific embodiments are in the ten to twelve foot range.

FIG. 1A illustrates an embodiment of a climbing structure 100 of the present teaching set at a 10-degree slab position.

The climbing structure 100 includes a wall assembly 102 having channels 104, 106 on both sides that enclose a chain drive system (not shown). The rigidity and alignment of the channels 104, 106 are important characteristics for proper operation of the climbing structure 100.

An array of panels 108 is positioned on the climbing surface of the wall assembly 102. For example, each panel in the array of panels 108 can be six inches tall and four or six feet wide. Also, each panel in the array of panels 108 has a number of holes configured to attach a variety of different climbing holds. The array of panels 108 follow a path back upward along the back side of the wall assembly 102 along a vertical loop with flat surfaces at the front and back.

A top cover 110 is positioned across and attached to each channel 104, 106 so as to cover the upper curve of the panel array trajectory. The top cover 110 prevents a climber's fingers from getting pinched between panels 108 as they rotate over the upper curve. A conveniently located brake handle 112 is positioned near the mid-point of the climbing structure 100 so that the climber can reach it during climbing in most positions.

Figure 1B:
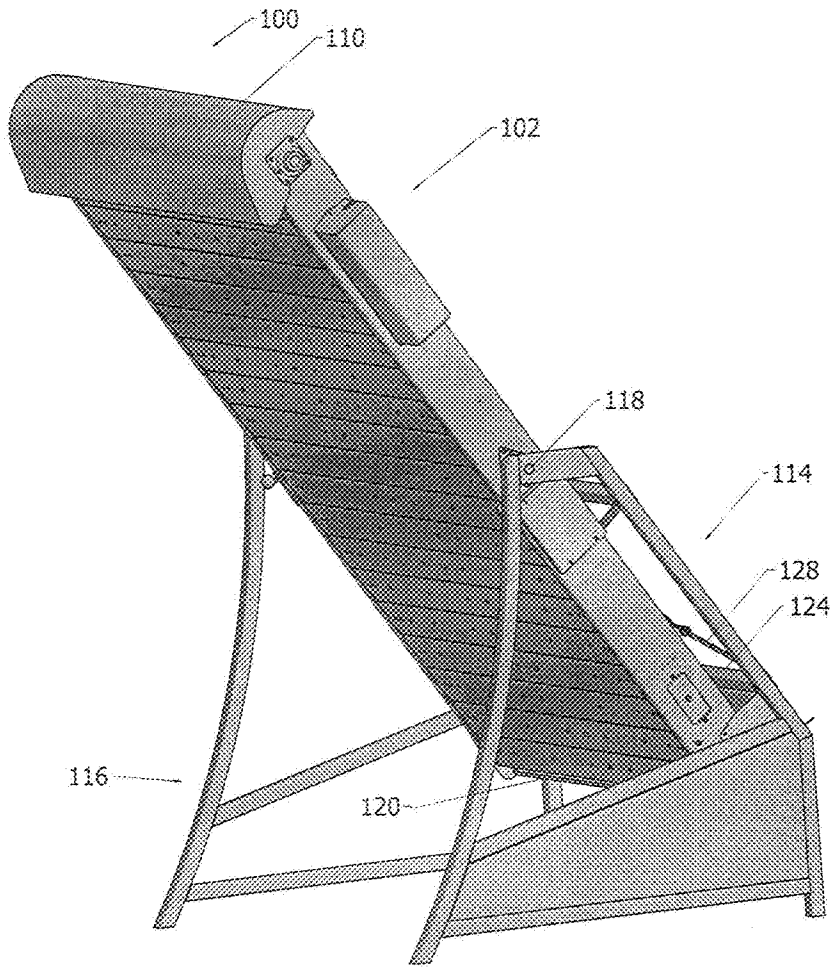
FIG. 1B illustrates an embodiment of the climbing structure described in connection with FIG. 1A set at a −35-degree overhang position.

One feature of the present teaching is the selection of the wall pivot point on the frame that includes two A-frame support frames 114, 116. While pivoting the wall from the base produces the smallest footprint, this position has the disadvantage that it produces relatively high major support forces, especially in the overhanging positions. Various means of dealing with these forces are inadequate without the use of motorized or other powered options. Pivoting the wall from the top creates similar problems and also requires an ungainly footprint. As such, and referring also to FIG. 1B, the climbing structure 100 uses a pivot point 118 that is at the center of the wall assembly 102 in the vertical direction. The two A-frame support frames 114, 116 are positioned to the right and left of the wall assembly 102 as shown in FIGS. 1A and 1B. The A-frames 114, 116 attach to the wall assembly 102 at the pivot point 118. The pivot point 118 is positioned on the channel 104 at a particular point that in some configurations that is slightly behind the center of gravity of the wall assembly 102 in the horizontal dimension, and nominally at the center of gravity of the wall assembly 102 in the vertical dimension, which is nominally at the center of the wall assembly 102 from top to bottom. This position of the pivot point 118 is chosen to allow the wall assembly to settle to a slab position when no climber is on the wall. This position of the pivot point 118 ideally allows for climber's body weight to shift the center of gravity of the wall assembly 102 to a point somewhat in front of the pivot point 118. With this shift in position of the center of gravity, the wall assembly 102 will tend to settle to an overhanging position. This allows the climber's body weight alone to adjust the angle. For example, in operation, the angle of the wall assembly 102 can be adjusted to any point from a 10-degree slab position to a −35 degree overhang position based on a position and a weight of a climber on the wall assembly 102.

Also, the position of the center of gravity of the wall assembly 102 used to determine the pivot point 118 is determined based on a wall assembly with no climbing holds. However, in operation, the center of gravity of the wall assembly 102 populated with various arrangements and number of climbing holds is nominally the same because they tend to be equally distributed around the panel array. Climbing structures according to the present teaching use a pivot point 118 in which the wall assembly 102 is supported from a position close to its center of gravity (COG). The number of holds used at various install locations varies considerably and some users put on as many as 140 holds weighing as much as 3 pounds each. Even if the holds are evenly distributed, the additional weight alters the position of the COG unless it is near the center of the wall height. The center of gravity can be adjusted by using counterweights so that the pivot point is in the desired location.

A brake mechanism (not shown) which is actuated by the brake handle 112 is used to fix the angle of the wall assembly 102 at a desired angle.

In an example of operation, a climber mounts the wall with the brake on and the wall at the nominally 10-degree slab position that occurs when no climber is on the wall. With the particular pivot point 118, the body weight of the climber is sufficient to move the wall the full range of wall angle when the brake is released. The climber fixes the desired wall angle by engaging the braking mechanism.

The bottom 120 of the wall assembly 102 is connected to the A-frames 114, 116 via a shaft assembly (not shown) described below. A panel 122 may be optionally fixed to one or both of the A-frames 114, 116. The panel 122 prevents interference with the wall assembly 102 motion.

In operation, as the climber ascends the wall assembly, the panels move downward in response to the forces of the climbing action. This downward rotation as the climber climbs provides a continuous climbing experience.

FIG. 1B illustrates the embodiment of the climbing structure 100 described in connection with FIG. 1A set at a −35-degree overhang position. FIG. 1B illustrates the angle as set by rotation of the wall assembly 102 around the pivot point 118. Referring to both FIGS. 1A and 1B, at the two extremes of the angle of the wall assembly 102, the bottom 120 of the wall assembly 102 does not extend substantially beyond the front or back of the base of the A-frames 116, 114.

Figure 1C:
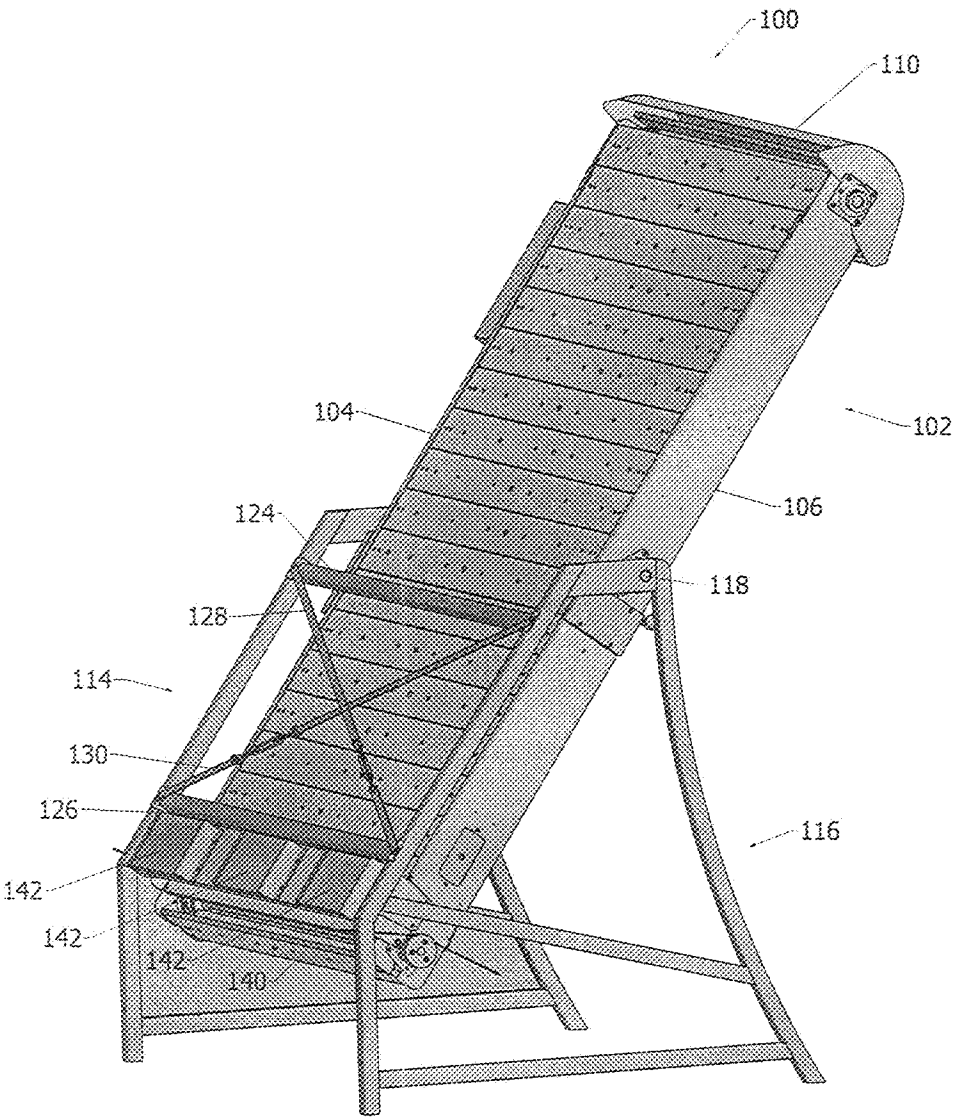
FIG. 1C illustrates a rear-view of the embodiment of the climbing structure of FIG. 1B.

FIG. 1C illustrates a rear-view of the embodiment of the climbing structure 100 set at a −35-degree overhang position. This rear-view clearly illustrates the two cross bars 124, 126 and two turnbuckle systems with braces 128, 130 that are used to attach the two A-frames 114, 116. On the wall assembly 102, a back shroud 140 is mounted to the right and left side channels 104, 106. The shroud 140 has three counter weights 142 which maintain the center of gravity of the wall assembly 102 at a location near the middle of the channels 104, 106. Pivot point 118, which is set slightly behind the center of gravity of the wall assembly 102 in the horizontal dimension, and nominally at the center of gravity of the wall assembly 102 in the vertical dimension, is shown on the A-frame 116.

One feature of the present teaching is that it is compatible with multiple desired climbing structure sizes and wall angle ranges. As described herein, in connection with the description of FIGS. 2A-C and 3A-C, in various embodiments, the A-frames are of two types of three sizes each. The upper sections of each frame are similar so that the only difference in the legs is their lengths. In this way a single welding jig can be used for all sizes.

Figure 2C:
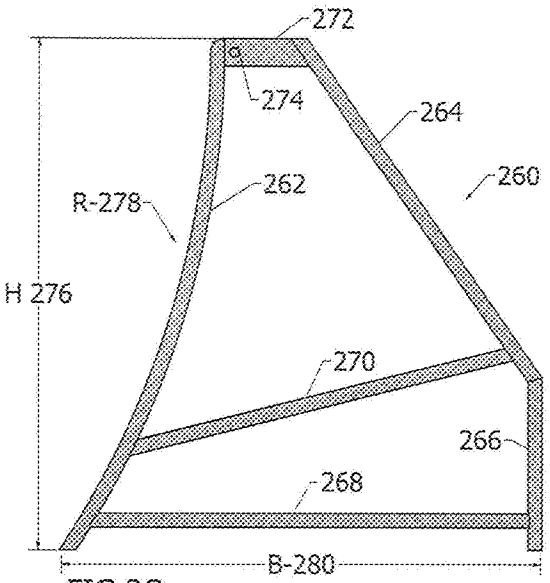
FIG. 2C illustrates a side-view of an embodiment of an A-frame supporting a steep-angle with a twelve-foot height of the present teaching.
Figure 2B:
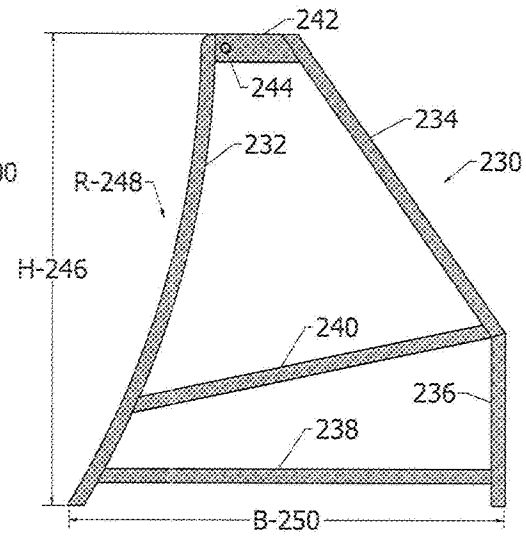
FIG. 2B illustrates a side-view of an embodiment of an A-frame supporting a steep-angle with an eleven-foot height of the present teaching.
Figure 2A:
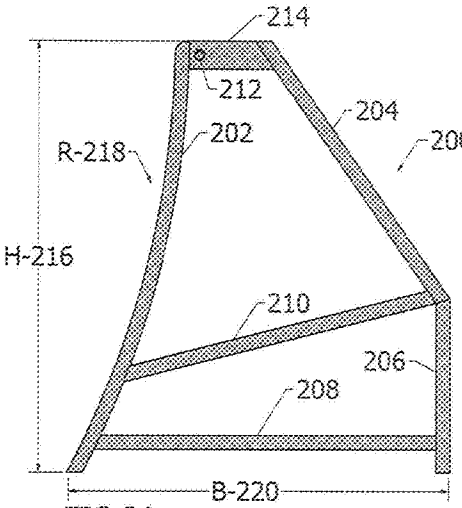
FIG. 2A illustrates a side-view of an embodiment of an A-frame supporting a steep-angle with a ten-foot height of the present teaching.

FIG. 2A illustrates a side-view of an embodiment of an A-frame 200 supporting a steep-angle with a ten-foot height of the present teaching. This embodiment of A-frame 200 is capable of supporting a wall angle from +10 to −35 degrees from vertical. A-frame 200 includes a front support leg 202, and a rear support leg with an upper section 204 and a lower section 206. A bottom cross bar 208 connects the front support leg 202 to the lower section 206 and a middle cross bar 210 connects the front support leg 202 to the upper section 204. The middle cross bar 210 forms an angle with the horizontal to support a wall angle from +10 to −35 degrees from vertical. An upper cross bar 214 connects the front support leg 202 to the upper section 204. The upper cross bar 214 includes a short shaft 212 that is positioned to connect a wall assembly.

The A-frame 200 has a height, H 216, of five feet. The front support leg 202 has a particular radius of curvature, R 218. This curved shape and associated radius, R, of the front support leg 202 beneficially positions the bottom of the front support leg at a sufficient distance, B 220, between the front support leg 202 and the lower section 206 to maintain stability of the climbing structure and minimizes interference with the climber and/or climbing functions because it curves away from the front of the climbing structure. The curve also provides a distinctive feature for branding and softens the look and feel of the climbing structure.

FIG. 2B illustrates a side-view of an embodiment of an A-frame 230 supporting a steep-angle with an eleven-foot height of the present teaching. This embodiment of A-frame 230 has similar elements and features as the embodiment described in connection with FIG. 2A. There is front support leg 232, a rear support leg with an upper section 234, a lower section 236, a lower cross bar 238, a middle cross bar 240, and an upper cross bar 242 with a short shaft 244 to connect a wall assembly. This embodiment of A-frame 230 has a height, H 246, of 5½ feet. The front support leg 232 has a particular radius of curvature, R 248, which positions the bottom of the front support leg 232 at a sufficient distance, B 250, to the lower section 236 to ensure stability of the climbing structure. This embodiment of A-frame 230 is capable of supporting a wall angle from +10 to −35 degrees from vertical.

FIG. 2C illustrates a side-view of an embodiment of an A-frame 260 supporting a steep-angle with a twelve-foot height of the present teaching. This embodiment of A-frame 260 has similar elements as the embodiments described in connection with FIGS. 2A and 2B. There is front support leg 262, a rear support leg with an upper section 264, a lower section 266, a lower cross bar 268, a middle cross bar 270, and an upper cross bar 272 with a short shaft 274 to connect a wall assembly.

This embodiment of the A-frame 260 has a height, H 276, of six feet. The front support leg 262 has a particular radius of curvature, R 278 that positions the bottom of the front support leg 262 at a sufficient distance, B 280, from the lower section 266 to ensure stability of the climbing structure. This embodiment of A-frame 260 is capable of supporting a wall angle from +10 to −35 degrees from vertical. The wall angle ranges for various embodiments of the climbing structure elements described herein are only examples of the present teaching and are not limiting in any way. A variety of wall angle ranges can be provided as will be understood by those skilled in the art.

Figure 3C:
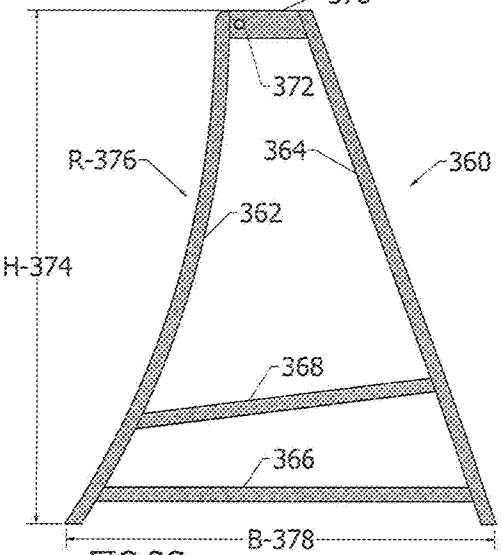
FIG. 3C illustrates a side-view of embodiment of an A-frame supporting a regular-angle with a twelve-foot height of the present teaching.
Figure 3B:
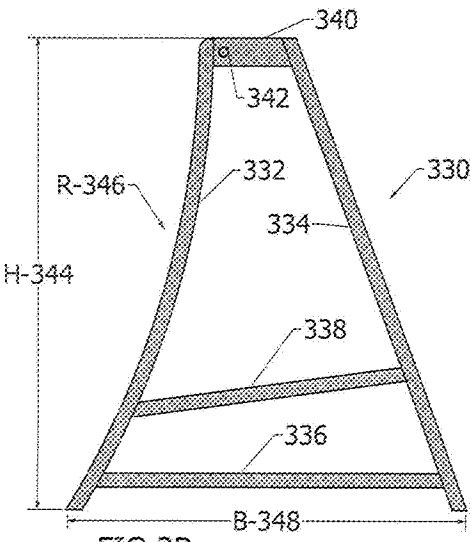
FIG. 3B illustrates a side view of embodiment of an A-frame supporting a regular-angle with an eleven-foot height of the present teaching.
Figure 3A:
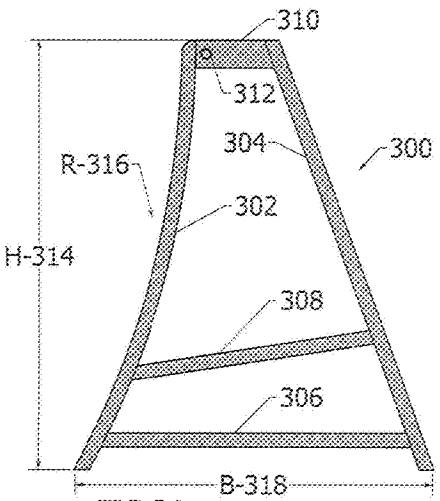
FIG. 3A illustrates a side-view of an embodiment of an A-frame supporting a regular-angle with a ten-foot height of the present teaching.

FIG. 3A illustrates a side-view of embodiment of an A-frame 300 supporting a regular-angle with a ten-foot height of the present teaching. This embodiment of A-frame 300 is capable of supporting a wall angle from +10 to −20 degrees from vertical. The A-frame 300 includes a front support leg 302, and a rear support leg 304. A bottom cross bar 306 and a middle cross bar 308 connect the front support leg 302 to the rear support leg 304. The middle cross bar 308 also connects to a wall assembly (not shown). The middle cross bar 308 forms an angle with the horizontal to support a wall angle from +10 to −20 degrees from vertical. An upper cross bar 310 connects the front support leg 302 to the rear support leg 304. The upper cross bar 310 includes a short shaft 312 that is positioned to connect a wall assembly. The A-frame 300 has a height, H 314, of five feet. The front support leg 302 has a particular radius of curvature, R 316. This curved shape and associated radius, R 316, of the front support leg 302 beneficially positions the bottom of the front support leg 302 at a sufficient distance, B 318, between the front support leg 302 and the rear support leg 304 to maintain stability of the climbing structure and minimizes interference with the climber and/or climbing functions because it curves away from the front of the climbing structure. The curve also provides a distinctive feature for branding and softens the look and feel of the climbing structure.

FIG. 3B illustrates a side-view of embodiment of an A-frame supporting a regular-angle with an eleven-foot height of the present teaching. This embodiment of A-frame 330 has similar elements and features as the embodiment described in connection with FIG. 3A. There is front support leg 332, and a rear support leg 334, a lower cross bar 336, a middle cross bar 338, and an upper cross bar 340 with a short shaft 342 to connect a wall assembly. This embodiment of A-frame 330 has a height, H 344, of 5½ feet. The front support leg 332 has a particular radius of curvature, R 346, that positions the bottom of the front support leg 332 at a sufficient distance, B 348, to the rear support leg 334 to ensure stability of the climbing structure. This embodiment of A-frame 330 is capable of supporting a wall angle from +10 to −20 degrees from vertical.

FIG. 3C illustrates a side-view of embodiment of an A-frame supporting a regular-angle with a twelve-foot height of the present teaching. This embodiment of A-frame 360 has similar elements and features as the embodiment described in connection with FIG. 3A. There is front support leg 362, and a rear support leg 364, a lower cross bar 366, a middle cross bar 368, and an upper cross bar 370 with a short shaft 372 to connect a wall assembly. This embodiment of A-frame 360 has a height, H 374, of six feet. The front support leg 362 has a particular radius of curvature, R 376, that positions the bottom of the front support leg 362 at a sufficient distance, B 378, to the rear support leg 364 to ensure stability of the climbing structure. This embodiment of A-frame 330 is capable of supporting a wall angle from +10 to −20 degrees from vertical.

Figures 4A, 4B:
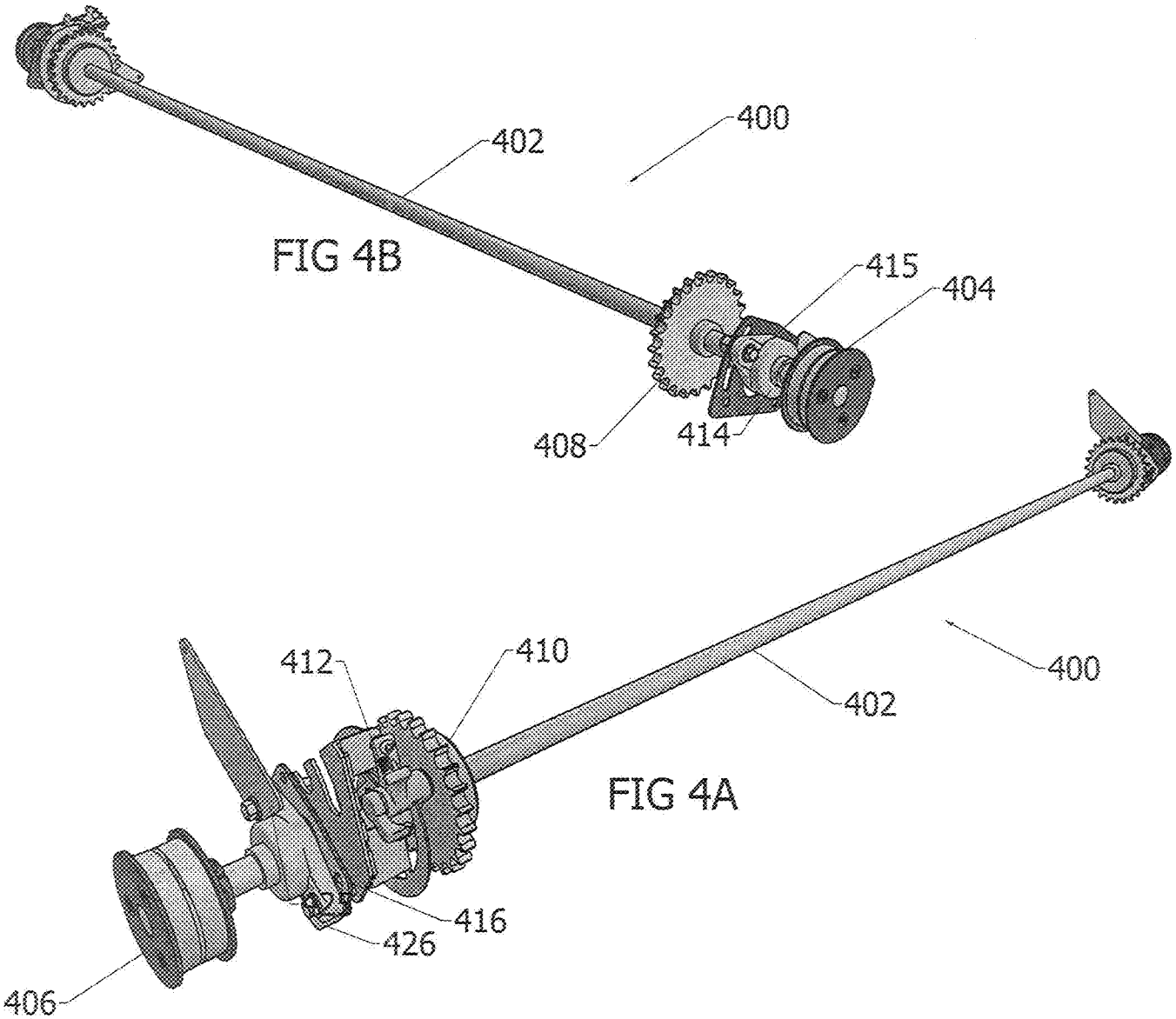
FIG. 4A illustrates a perspective view of an embodiment of a lower shaft assembly of the present teaching.
FIG. 4B illustrates another perspective-view of the embodiment of a lower shaft assembly of FIG. 4A.

One aspect of the present teaching is realization that the lower sprocket shaft can be used for more than a chain-tensioning device. FIG. 4A illustrates a perspective-view of an embodiment of a lower shaft assembly 400 of the present teaching. FIG. 4B illustrates another perspective view of the embodiment of a lower shaft assembly 400 of FIG. 4A. One feature of the present teaching is that the lower shaft assembly 400 allows for three important functions. Referring to FIGS. 1A and 4A-B, the lower shaft assembly 400 maintains tension on the chains (not shown) that are housed in channels 104, 106. The lower shaft assembly 400 controls the wall angle of the wall assembly 102. The lower shaft assembly 400 also maintains alignment of the channels 104, 106.

The shaft assembly 400 includes the bottom shaft 402 with cable hub assemblies 404, 406 attached to the ends of the shaft 402. These cable hub assemblies 404, 406 can be configured to clamp the cables 403, 405 rather than to have the cables 403, 405 pass internally so as to make the cables 403, 405 easily replaceable in case of damage or to perform maintenance. As described in connection with FIG. 5, the cables 403, 405 are spring loaded at the rear end and are attached to the front and rear legs of respective A-frames 114, 116 and maintain the two channels 104, 106 in excellent and solid alignment at all wall angles. The cable hub assemblies 404, 406 and cables 403, 405 are used to guide the movement of the wall assembly 102 through various wall angles. The two cable hub assemblies 404, 406 rotate the shaft 402 as the wall angle changes.

Two sprockets 408, 410 are positioned at either end of a shaft 402. In some configurations, the sprockets 408, 410 are not keyed to the shaft 402. Instead, the sprockets 408, 410 are on bearings that rotate freely. This results in the shaft 402 at the bottom of the wall that rotates independently from the sprockets 408, 410. One advantage the shaft 402 rotating independently is that the shaft 402 can then be used with a cable arrangement to align the channels and to provide an angle-locking means. The sprockets 408, 410 are driven by two chains (not shown) in the channels 104, 106. The chains guide the movement of the array of panels 108.

With the cable arrangement in place, there are a couple of ways to lock the wall angle. One means to lock the wall angle is to use a dampening cylinder with a locking mechanism. Dampening of the wall angle change is necessary to control the speed of the angle change, but cylinders that lock in this way are not common and, therefore are expensive. Known cylinders also have questionable durability in a fitness environment. Another means for locking the wall angle is to control the rotation of the lower shaft with a braking system. This can be accomplished with the use of a disk brake. There are many types of suitable disk brakes. One relatively inexpensive type of disk brake that is suitable for this application in size and braking capability is a bicycle-type caliper brake. This type of brake is controlled by a cable-lever system that the climber can easily control.

A disc brake mechanism 412 is used to fix the wall assembly 102 at a particular wall angle. The shaft assembly 400 is attached at one end to the channel 104 using a bearing 415 and a plate 414 and at the other end to the channel 106 using a bearing 425 and plate 426. Plates 414 and 426 are equipped with a slot 416 which allows bearings 415, 425 to pivot to allow for the relative motion between the wall assembly 102 and the shaft as the wall is in operation and to allow tension adjustment of the chains (not shown). The disc brake system 412 when activated will halt the rotation of the shaft 402 to hold the wall angle at all points in the wall angle range.

Figure 4D:
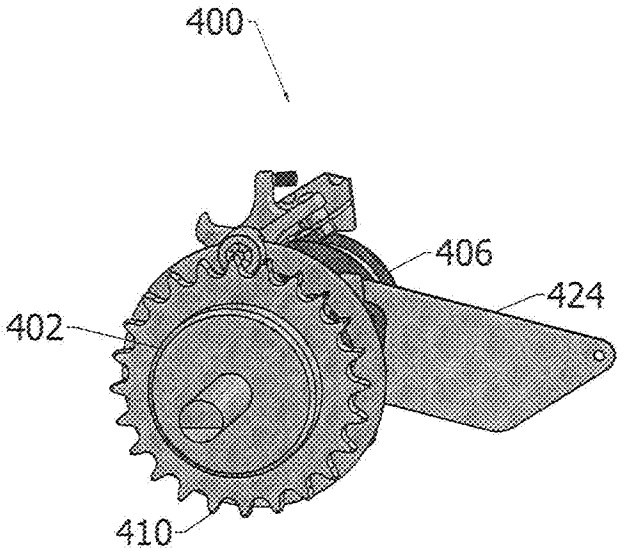
FIG. 4D illustrates another detailed perspective-view of the left end of the embodiment of a lower shaft assembly of FIG. 4A.
Figure 4F:
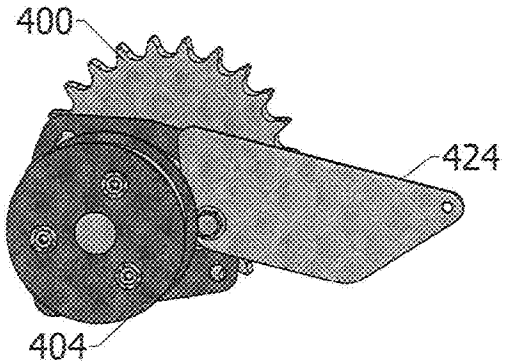
FIG. 4F illustrates another detailed perspective-view of the right end of the embodiment of a lower shaft assembly of FIG. 4A.
Figure 4C:
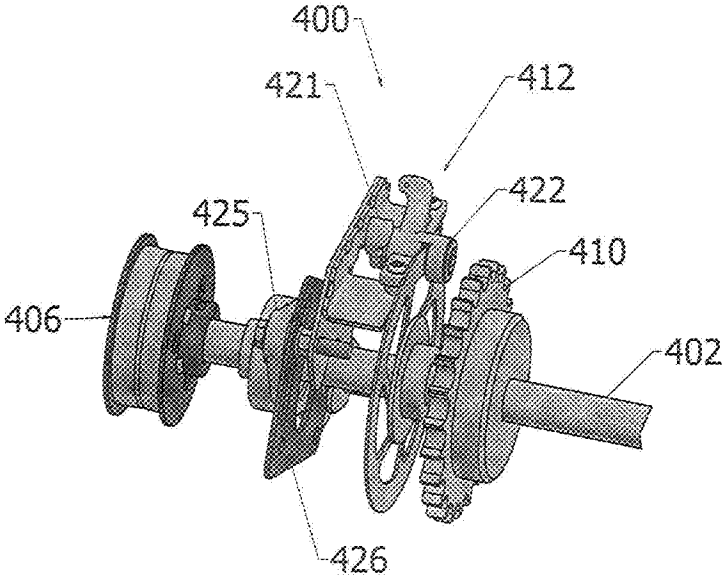
FIG. 4C illustrates a detailed perspective-view of the left end of the embodiment of a lower shaft assembly of FIG. 4A.

FIG. 4C illustrates a detailed perspective view of the left end of the embodiment of a lower shaft assembly 400 of FIG. 4A. FIG. 4D illustrates another detailed perspective view of the left end of the embodiment of a lower shaft assembly 400 of FIG. 4A. The disc brake system 412 includes a disc 420, attached to the shaft 402, a caliper mounting plate 421 and a caliper 422 that applies pressure to the disc 420 to stop rotation of the shaft 402. Releasing the caliper 422 allows rotation of the shaft 402. The disc brake system 412 is designed to work at all wall angles. The disc 420 is rigidly attached to the shaft, and the caliper mounting plate 421 is mounted on the bolts that hold bearing 425 so the caliper 422 can float along with the shaft 402 with respect to the wall channels 104, 106. The sprocket 410 is free to rotate around the shaft 402. The cable hub assembly 406 is rigidly attached to the shaft 402. A bearing lever 424 is spring loaded so that tension is maintained on a chain (not shown) engaged by the sprocket 410 when the shaft assembly 400 is attached to the wall channels 104, 106.

Figure 4E:
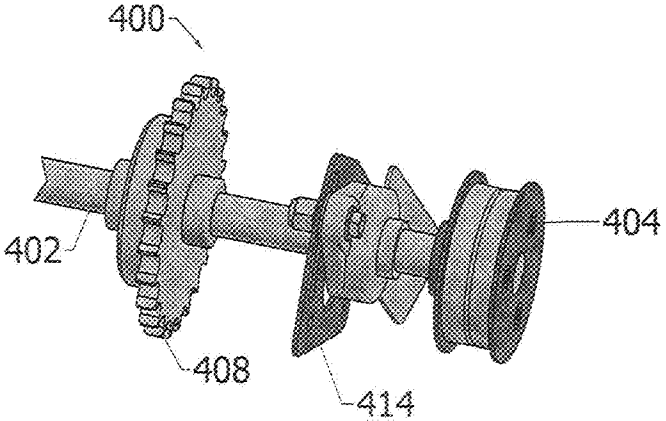
FIG. 4E illustrates a detailed perspective-view of the right end of the embodiment of a lower shaft assembly of FIG. 4A.

One feature of the present teaching is that it is easy to assemble on site. FIG. 4E illustrates a detailed perspective view of the right end of the embodiment of a lower shaft assembly 400 of FIG. 4A. FIG. 4F illustrates another detailed perspective view of the right end of the embodiment of a lower shaft assembly 400 of FIG. 4A. Sprocket 408 is free to rotate around the shaft 402. The cable hub assembly 404 is rigidly attached to the shaft 402. The shaft assembly attaches to the wall assembly via simple bolting of the mounting plate 414. Mounting plate 414 is secured to the channels 104, 106. A bearing lever 424 is spring loaded so that tension is maintained on a chain (not shown) engaged by the sprocket 408 when the shaft assembly 400 is attached to the wall channels 104, 106. The attachment for the other side is configured similarly. The shaft assembly 400 is attached to the A-frames 114, 116.

Figure 5:
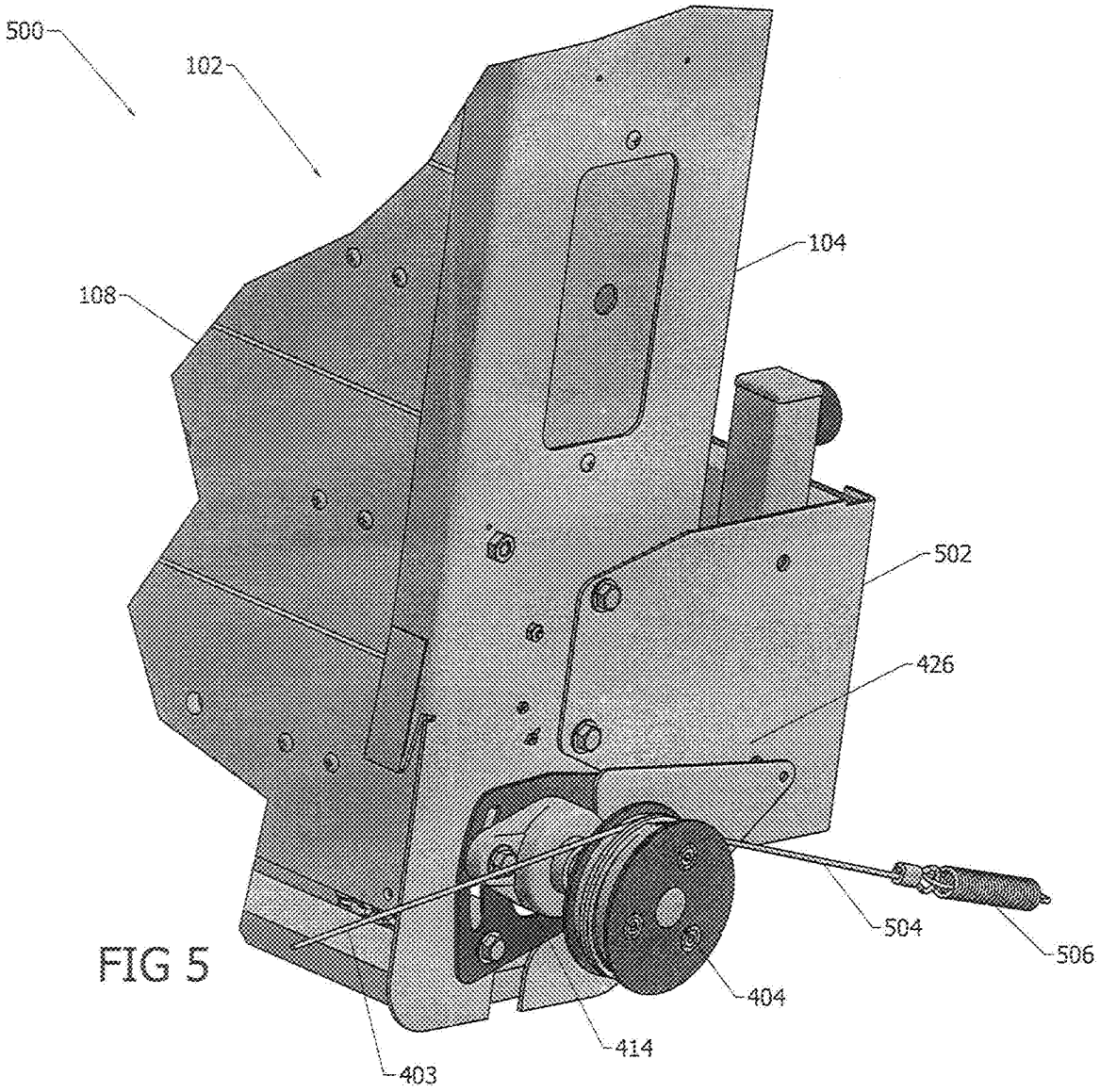
FIG. 5 illustrates a partial-view of an embodiment of a right channel of a portion of the wall assembly attached to a shaft assembly of the present teaching.

FIG. 5 illustrates a partial view of an embodiment of a right channel of a portion 500 of the wall assembly attached to a shaft assembly of the present teaching. The right channel guide 104 contains the chain (not shown) that guides wall panels 108 as they rotate around the wall assembly 102. Mounting plate 414 attaches to the guide 104. The bearing lever 424 is attached to a back guard 502. A bearing tension lever spring attaches between the lever 426 and the top of the back guard 502 to maintain chain tension. Cable hub assembly 404 attaches via a back section 504 of cable 403 and a spring 506 to a rear leg of the A-frame 114 (not shown). The wall assembly left channel portion (not shown) is similarly configured to the right channel portion 500 shown in FIG. 5.

Figures 6A, 6B:
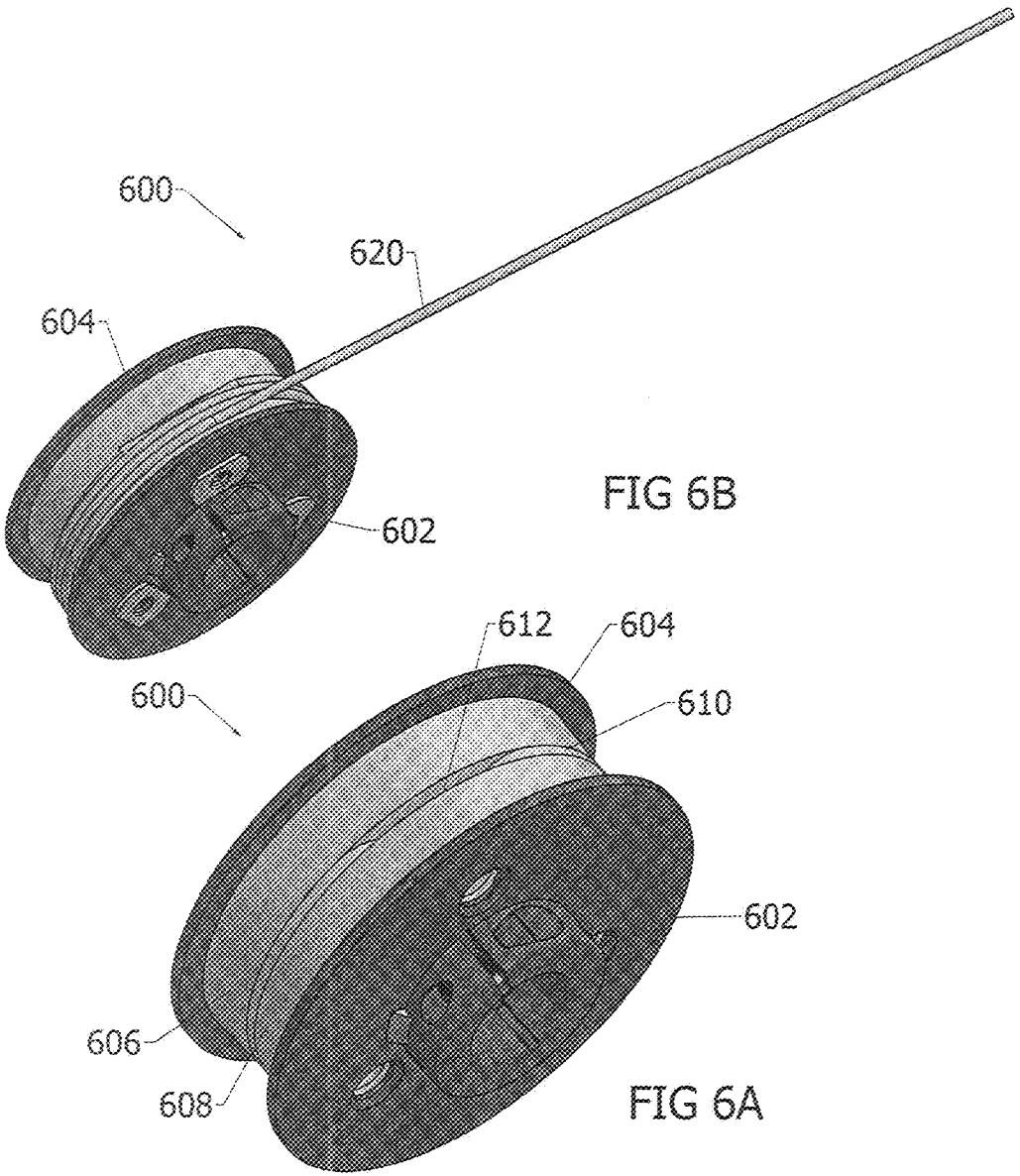
FIG. 6A illustrates an embodiment of a cable hub assembly without cable of the present teaching.
FIG. 6B illustrates an embodiment of a cable hub assembly of FIG. 6A with cable.
Figure 6C:
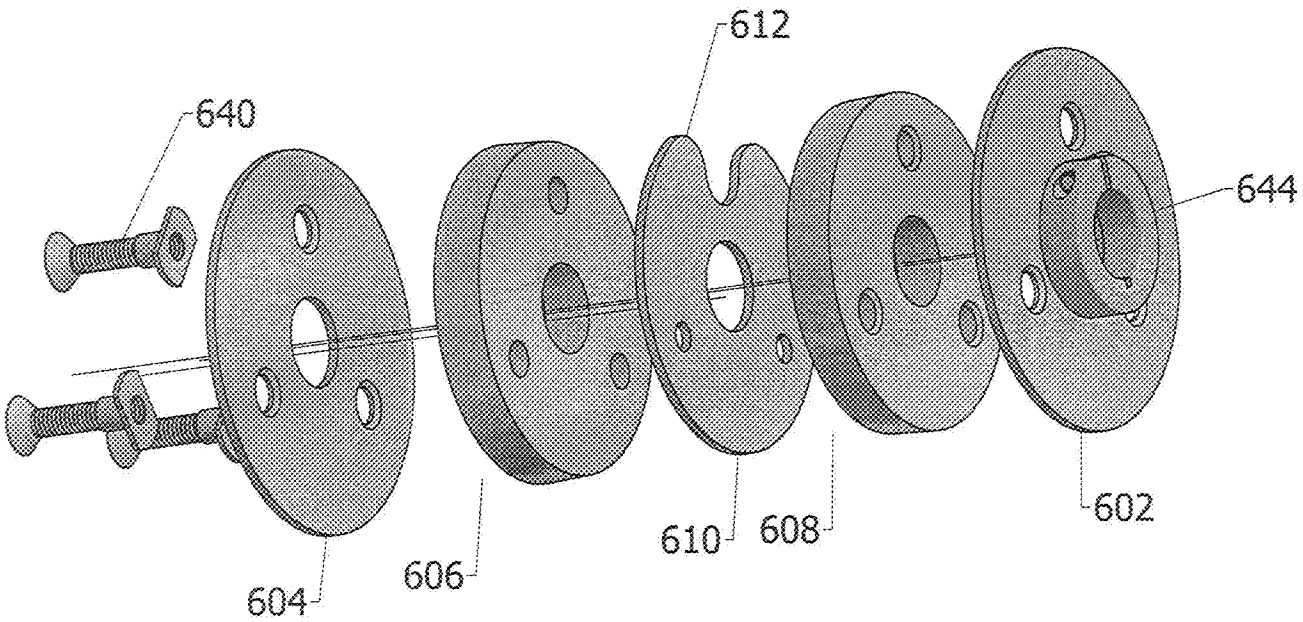
FIG. 6C illustrates an exploded view of the embodiment of the cable hub assembly of FIG. 6A.

FIG. 6A illustrates an embodiment of a cable hub assembly 600 without cable of the present teaching. Two outer flanges 602, 604 are positioned on either side of two hubs 606, 608, that are positioned on either side of a center disk 610. The center disk 610 has a cut-out 612. FIG. 6B illustrates an embodiment of a cable hub assembly 600 with cable 620 of FIG. 6A. A cable 620 is slipped into the slot formed by the cut-out 612 on the center disk 610 during assembly and held into place by the hubs 606, 608. Each hub 606, 608 is angled from the outer flanges 604, 606 toward the center disk 610 at a shallow 3-degree angle to keep the cable winding properly aligned as the cable 620 winds and unwinds from the cable hub 600 during operation. The 3-degree taper guides the cable 620 toward the center of the cable hub assembly 600. FIG. 6C illustrates an exploded view of the embodiment of the cable hub assembly 600 of FIG. 6A. In addition to outer flanges 602, 604, hubs 606, 608 and disk 610 with cut-out 612, the threaded inserts 642 and screws 640 that hold the cable hub assembly 600 together are shown. A locking collar 644 is used to secure the hub to the shaft.

Figure 7C:
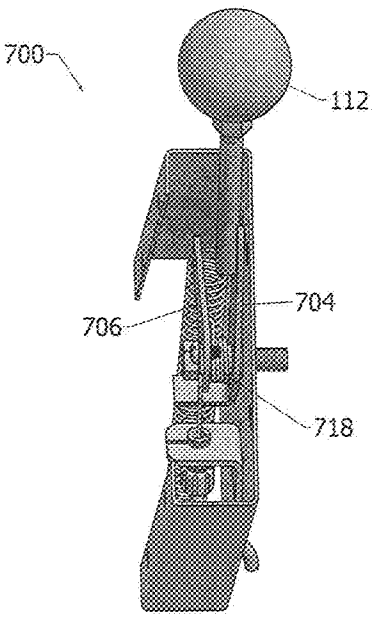
FIG. 7C illustrates a third perspective-view of the soft-lever control mechanism of FIG. 7A.
Figure 7B:
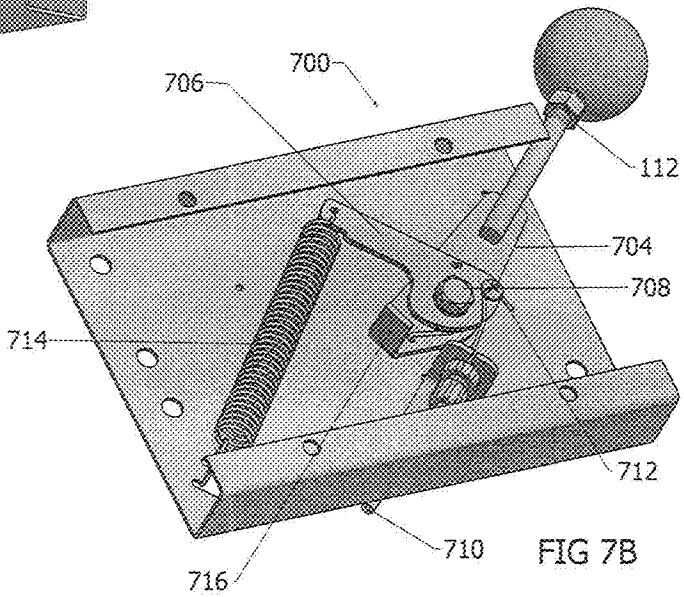
FIG. 7B illustrates another perspective-view of the soft-lever control mechanism of FIG. 7A.
Figure 7A:
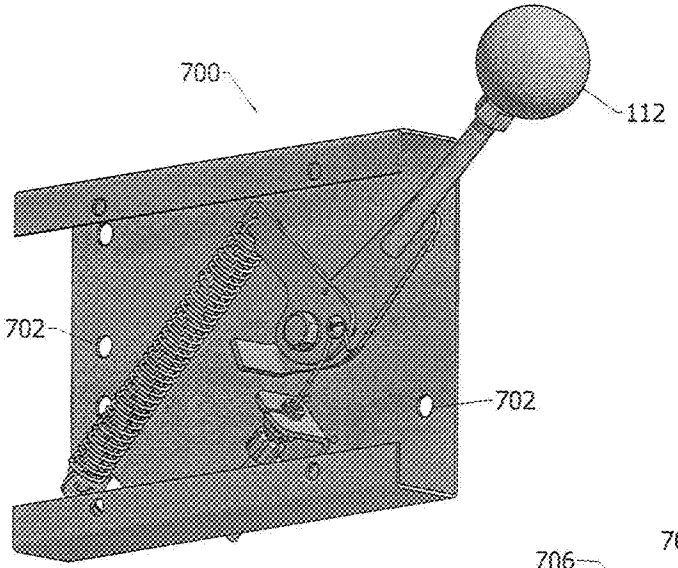
FIG. 7A illustrates a perspective-view of an embodiment of a soft-lever control mechanism of the present teaching.

As described herein, one feature of the present teaching is that the wall angle can be controlled by the climber during operation. Body weight of a climber is sufficient to change the wall angle and a braking mechanism is controlled by the climber to set the wall at the desired angle. FIG. 7A illustrates a perspective view of a soft-lever control mechanism 700 of the present teaching. Referring to FIGS. 1A and 7A, the soft-lever mechanism 700 attaches to the wall assembly 102 channel 106 using attachment holes 702. This positioning makes brake handle 112 easy to reach by a climber that is on the wall assembly in operation. FIG. 7B illustrates another perspective view of a soft-lever control mechanism 700 of FIG. 7A. Brake handle 112 is attached to a bottom plate 704 that serves as an adjustment lever. A top plate 706 that serves as a caliper control lever, is attached to the bottom plate 704 at pivot bolt 708. The top plate 706 and bottom plate 708 pivot independently on the pivot bolt 708. The two plates 704, 706 are coupled to each other through the torsion spring (FIG. 7C). The cable 710 connects to the caliper (not shown). A screw 712 locks the cable and facilitates adjustment. The main spring 714 actuates the angle locking caliper. A lug 716 presses against the top plate 706 to fully release the caliper at the end of the stroke of the bottom plate 704 (adjustment lever). FIG. 7C illustrates a third perspective view of the soft-lever control mechanism 700 of FIG. 7A. FIG. 7C illustrates the torsion spring 718 that links the top plate 706 to bottom plate 704.

Referring to FIGS. 7A-C, in the rest position, the main spring 714 pulls down on the caliper control lever, top plate 706. This locks the angle of the wall in place. As the adjustment lever, bottom plate 704 is moved down, the torsion spring 718 between the two plates 704, 706 gradually increases force against the top plate 706. This counters the force that the main spring 714 exerts against the cable 710. This causes the caliper to release slowly, rather than a sudden release. At the bottom of the stroke, the lug 716 on the bottom plate 704 presses against the top plate 706 (caliper control lever), forcing the lever up (top plate 706) to ensure the full release of the caliper. This design of the soft-lever control mechanism 700 advantageously prevents abrupt action from the braking control mechanism. This is sometimes referred to as "soft-release" braking.

Figure 8B:
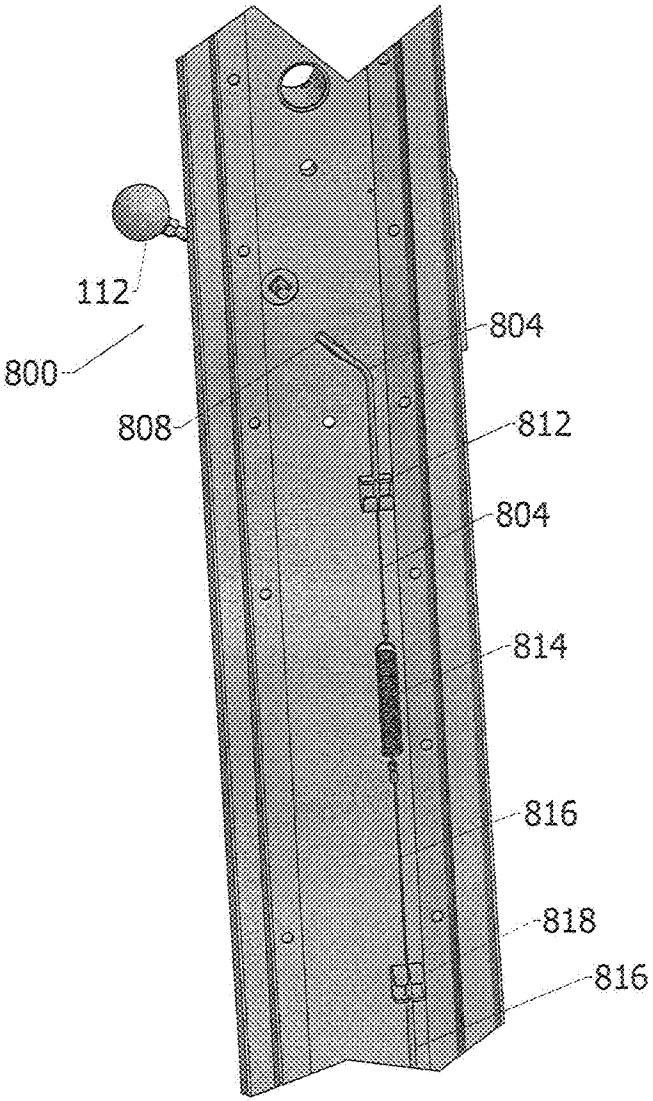
FIG. 8B illustrates another perspective-view of the inside of the soft-lever control mechanism embodiment of FIG. 8A.
Figure 8A:
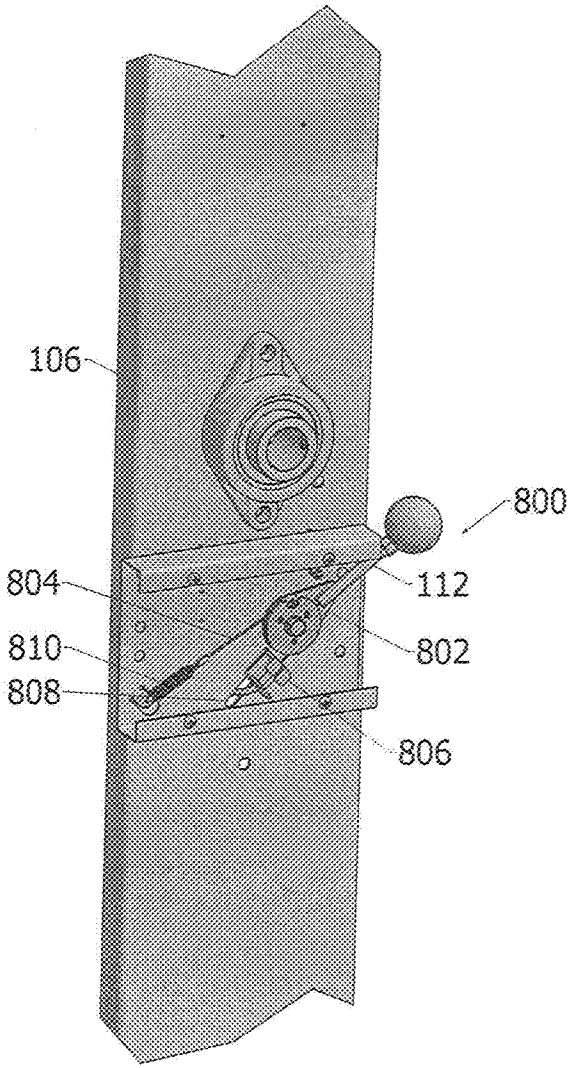
FIG. 8A illustrates a perspective-view of another embodiment of a soft-lever control mechanism of the present teaching.

FIG. 8A illustrates a perspective-view of another embodiment of a soft-lever control mechanism 800 of the present teaching. The soft-lever control mechanism 800 is mounted on a channel 106. A brake handle 112 is used by the climber to actuate the braking mechanism and set the desired wall angle. The brake handle 112 is attached to a lever assembly 802. The lever assembly 802 has pulley-like disks for accepting a cable 804. The cable 804 is looped around the lever assembly 802 and fed through a cable stop 806. One end of the cable 804 exits the channel through the slot 808. The cable 804 is enclosed in a cover after the cable stop 806. The other end of the cable 804 is attached to one end of a balance spring 810. The other end of the balance spring 810 is secured to the channel 106. The balance spring 810 acts to return the lever assembly 800 to a neutral position. When the brake handle 112 is at the upper most position (as shown) the soft-lever control mechanism 800 is in a neutral position. In the neutral position the brake is applied and the wall remains at the angle. Moving the brake handle 112 downward releases tension of the cable on the caliper (not shown). This allows the wall to move along the wall angle range. Releasing the handle 112 causes the brake to set, and the wall angle to be held at a desired angle.

FIG. 8B illustrates another perspective-view of the inside of the soft-lever control mechanism 800 of FIG. 8A. Referring to both FIGS. 8A-B, the covered cable 804 comes through to the other side of the channel 106 at the slot 808. The cable 804 passes through a second cable stop 812. This section of the cable 804 is covered. The bare cable 804 then passes to an attachment to a main spring 814. The main spring 814 tensions the cable to lock the caliper (not shown). The main spring 814 is weaker than the balance spring 810. Moving the brake handle 112 down releases the tension on the main spring 814. Another bare cable 816 is attached to the other side of the main spring 814. This bare cable 816 passes through a third cable stop 818. The cable 816 exits the cable stop 818 and connects to the caliper (not shown) through a cover.

EQUIVALENTS

While the applicants' teaching is described in conjunction with various embodiments, it is not intended that the applicants' teaching be limited to such embodiments. On the contrary, the applicants' teaching encompass various alternatives, modifications, and equivalents, as will be appreciated by those of skill in the art, which may be made therein without departing from the spirit and scope of the teaching.

What is claimed is:

1. A climbing structure comprising:

a) a support frame;

b) a wall assembly comprising a chain arranged as a loop with an array of climbing panels attached to the chain so as to maintain a configuration that rotates the climbing panels downward as the user climbs to achieve a continuous climbing experience; and c) a lower shaft assembly comprising:

1) a shaft that rotates based on an angle of the wall assembly;

2) a sprocket that maintains tension on the chain as the climbing panels rotate downward, the sprocket being mounted to the shaft such that the shaft and the sprocket rotate independently;

3) a cable hub assembly rigidly attached to the shaft and securing a cable that is attached to the support frame; and 4) a disc braking system comprising a disc rigidly attached to the shaft and a caliper mounted on bearing bolts such that the disc braking system fixes the angle of the wall assembly without affecting the continuous climbing experience.

2. The climbing structure of claim 1 wherein the wall assembly is attached to the support frame at a pivot point that is proximate to and behind the center of gravity of the wall assembly.

3. The climbing structure of claim 1 wherein wall assembly is configured to have an angular range that is from 10 degrees to −35 degrees.

4. The climbing structure of claim 1 wherein wall assembly is configured to have an angular range that is from 10 degrees to −20 degrees.

5. The climbing structure of claim 1 wherein the support structure comprises a curved front support leg.

6. The climbing structure of claim 1 wherein the cable hub assembly comprises a central disc with a cut-out.

7. The climbing structure of claim 6 wherein the cable is secured in the cable hub assembly using the cut-out.

8. The climbing structure of claim 1 wherein the cable hub assembly comprises a hub with a three-degree taper.

9. The climbing structure of claim 1 wherein the climbing panels are less than or equal to four feet wide.

10. The climbing structure of claim 1 wherein the climbing panels are less than or equal to six feet wide.

* * * * *